US007607701B2

(12) United States Patent
Levine

(10) Patent No.: US 7,607,701 B2
(45) Date of Patent: Oct. 27, 2009

(54) ADJUSTABLE LATCH

(76) Inventor: Steven Levine, 333 Mamaroneck Ave., #235, White Plains, NY (US) 10605

( * ) Notice: Subject to any disclaimer, the term of this patent is extended or adjusted under 35 U.S.C. 154(b) by 228 days.

(21) Appl. No.: 11/303,733

(22) Filed: Dec. 16, 2005

(65) Prior Publication Data

US 2006/0186672 A1 Aug. 24, 2006

Related U.S. Application Data

(60) Provisional application No. 60/636,824, filed on Dec. 16, 2004.

(51) Int. Cl.
*E05C 1/08* (2006.01)
*E05C 1/00* (2006.01)

(52) U.S. Cl. ..... 292/163; 292/1.5; 292/169; 292/337; 292/DIG. 60

(58) Field of Classification Search ..... 292/1.5, 292/137, 163, 169, 337, 2, DIG. 60
See application file for complete search history.

(56) References Cited

U.S. PATENT DOCUMENTS 671,792 A * 4/1901 Comber ..... 292/2
1,720,638 A * 7/1929 Wread ..... 292/169.22
1,720,639 A * 7/1929 Wread ..... 292/2
1,724,630 A * 8/1929 Wilson ..... 292/169.21
1,871,633 A * 8/1932 Ter Meer ..... 292/169.19
2,937,897 A * 5/1960 Soderberg ..... 292/1.5
4,662,666 A * 5/1987 Wimmer ..... 292/1.5
5,123,684 A * 6/1992 Yeh ..... 292/244
5,458,382 A * 10/1995 Boadwine et al. ..... 292/337
5,489,128 A * 2/1996 Florian ..... 292/1.5
5,957,510 A * 9/1999 Kuo ..... 292/1.5

* cited by examiner

*Primary Examiner*—Carlos Lugo
(74) *Attorney, Agent, or Firm*—Thomas A. O'Rourke; Bodner & O'Rourke, LLP

(57) ABSTRACT

An adjustable door latch that enables one to adjust its length without removing any functionality from other areas of the door latch assembly. The improved door latch assembly includes a strike plate, adjustment head, adjustment stem, resilient member, and housing. The improved door latch utilizes a threaded adjustment head, which is screwed into an adjustment stem. The adjustment stem has a threaded aperture located on the front surface of a circular disc. The circular disc has at least one rib, which fits into the groove of a drum, this configuration prevents rotation of the circular disc when adjustment is necessary. The adjustment member and stem have apertures that allow one to thread the spindle of a door knob through the door latch assembly and to the other door knob.

13 Claims, 13 Drawing Sheets

ADJUSTABLE LATCH

This application claims priority from an earlier filed provisional patent application 60/636,824, filed Dec. 16, 2004 the disclosures of which are hereby incorporated by reference.

FIELD OF INVENTION

The present invention relates to door latches, in particular a door latch that has an adjustable head.

BACKGROUND OF THE INVENTION

A cylindrical lock is typically one in which two holes are drilled into the door. A larger hole is bored into the door face and a smaller crossbore hole is bored into the door edge. Typically, the face hole is sized from 1.5 inches to 2.125 inches and is centered at 2⅜ inches or 2¾ inches from the leading edge of the door; this distance is referred to as the backset. Other, less popular, backsets are at 3¾ and 5 inch. Residential doors are normally prepared for 2⅜" backset and commercial doors at 3¾" backset. The cylindrical lock was invented by Walter Schlage in 1909. The bored cylindrical lock arose from a need for a more cost-effective method of locking doors. The previous norm, the mortise lock, which derived this name from the mortise you, must create in a door in order to install the lockset. A mortise is a deep cavity, usually rectangular, which is created in the edge of a door. The successful creation of the cavity can often only be achieved with specialized tools and skill; once created you can then install the lockset which is filled with levers, cams, and springs. Because of the complexity of the mortise device, and its higher manufacturing cost as well as it's more labor intensive installation made the bored cylindrical lock an ideal substitute, both in price and functionality. The great majority of locks now in use on residences is a variation of the cylindrical lock and is known as tubular chassis locks.

Both the mortise type locks and the cylindrical type locks have a common feature, both utilize a latching mechanism to keep the door closed. A latch is a type of mechanical hardware, specifically a fastener, which is used to join two (or more) objects or surfaces together while allowing for the regular or eventual separation of the objects or surfaces. Some common types of latches include: Spring Slam, Compression Draw (Over & Under-Center), and Rotary Cam. Latches range in complexity from flexible one piece flat springs of metal or plastic, such as are used to keep blow molded plastic power tool cases closed, to multi-point cammed latches used to keep large doors closed. There are many ways to obtain latches for various applications. A hardware store or distribution center is a convenient and cost effective way to find standard hardware. A latch typically engages another piece of hardware on the other mounting surface. Depending upon the type & design of the latch, this engaged bit of hardware may be known as a keeper or a strike. Latches are typically implemented with doors, more specifically door knobs and/or door locks. Generally, a door latch will be implemented to keep a door closed.

A doorknob is a popular type of handle used for opening and closing a door. In its simplest form, a doorknob provides only a place to grab so that the door may be pulled toward oneself. On most modem doors, however, doorknobs can be turned to operate a latching mechanism, which normally holds the door closed. A doorknob may also have a lock built in, though in some cases it is beneficial for the lock to be separate. Doorknobs can be difficult for the young and elderly to operate. If a person lacks a firm grip a doorknob must sometimes be operated using two hands. For this reason doors in most commercial and industrial buildings and in many households now use an operating lever, rather than a doorknob, as the lever does not require a firm grip. Levers are also beneficial on doors with narrow stile widths where the reduced backset leaves insufficient space to comfortably turn a doorknob. Most household doorknobs use a simple mechanism with a screw-style axle (also called a spindle) with two flat ends, to be threaded through the door latch, and two knob sides. The location of the doorknob on the door may vary between a few centimeters away from the door frame to the exact center of the door, depending on local culture or owner preference. The distance from the edge of the door to the center of the doorknob is called a backset. Knobs are attached on both sides by screwing them directly onto the axle, and then securing one or more retaining screws on the side of the knob's axle.

There are a number of problems that may arise with a door latch, whether during installation, or do to normal wear and tear. For example doorknobs sometimes lose traction, which can generally be repaired by replacing the screw, which prevents them from slipping on the axle. Sometimes a door won't latch closed unless you slam it, the strike plate mounted on the door jamb is probably out of alignment, this is usually caused by normal wear and tear of the strike plate of the door. One may correct this misalignment by slackening the strike plate screws and moving the plate adjustment in any direction. Another more cumbersome alternative would be to remove the strike plate, clamp it in a vise or other holding apparatus, and file the interfering edge of the plate.

In addition to normal wear and tear, doors, like windows, require precise measurements when being installed. A miscalculation of even a ⅛ of an inch could sometimes cause the door latch not to close. The present invention gives the user the ability to adjust a door latch, whether the malfunction is caused by normal wear and tear, or improper installation, via a bored cavity located on the face of the head portion of the door latch.

OBJECTS OF INVENTION

It is an object of the present invention to provide an improved door latch assembly It is an object of the present invention to provide a door lock assembly that has an adjustable latch portion.

It is an object of the present invention to provide a door lock with an adjustable latch that is simple and cost effective to manufacture.

It is still another object of the present invention to provide a door lock that may be inserted into a bored cavity located on the front edge of the door.

It is still another object of the present invention to provide a door lock that is aesthetically pleasing.

It is yet another object of the present invention to provide a door lock that is capable of receiving a multitude of door knobs.

SUMMARY OF INVENTION

The present invention includes a door lock assembly with an adjustable latch portion. The adjustable door latch of the present invention has a head or tongue, which may have a generally parabolic surface with an aperture located on the surface thereof. Alternatively, instead of a tongue there can be a roller. The roller would typically be generally cylindrical with a center axis and an axle that passes through the axis. A roller arrangement is shown in my earlier patent, U.S. Pat. No. 6,592,156, the disclosures of which are incorporated herein by reference. The aperture may be of any suitable shape, a preferred shape is polygonal. In addition, located on the base of the adjustable latch portion is a threaded protrusion. The threaded protrusion is used as an adjusting means for the door latch. In one embodiment there is flange located on the base of the adjustable head portion. The door latch assembly of the present invention has an adjustment stem. Located near the center of the disc portion of the adjustment stem is a threaded aperture. The adjustable head portion of the latch is screwed into the threaded aperture of the adjustment stem. The disc portion of the adjustment stem may also have at least one rib portion or arm located on the outside circumferential surface. The rib portion acts as a guide prevents the disc from rotating with the head during adjustment. The rib or guide also prevents side to side movement of the head. The present invention allows the user to adjust the door latch via the adjustment head when more surface area of the adjustment head is needed.

BRIEF DESCRIPTION OF INVENTION

FIG. 1 A is cross-sectional view of the adjustable latch of the present invention with the tongue exposed.

FIG. 1 B is cross-sectional view of one embodiment of the adjustable latch of the present invention with the tongue retracted.

DETAILED DESCRIPTION OF THE INVENTION

Figure 1A:
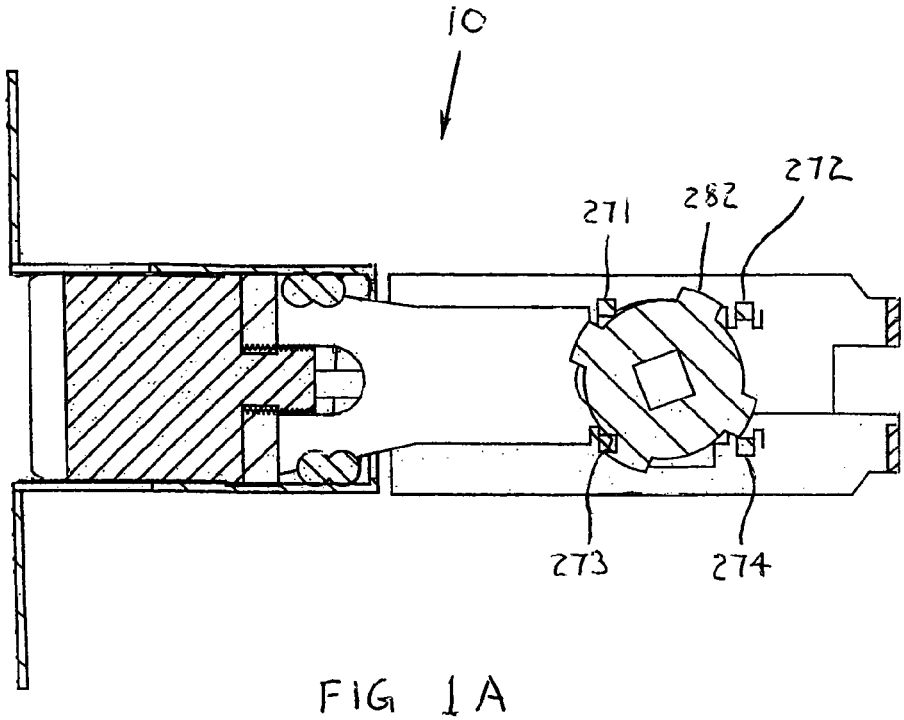

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The adjustable door latch assembly 10 (hereinafter latch) of the present invention may be seen in FIGS. 1 A and B. The assembly of the present invention may as shown in the Figures, which are typically for non-locking interior doors, or the assembly can have a locking feature if desired. The latch 10 of the present invention includes a strike plate cover 20, a threaded adjustable head 40 (hereinafter head), a disk stop guide, an adjustment stem 250, a spring 60, and a housing 70, all of which may be seen in more detail in FIGS. 2 and 9.

Figure 14:
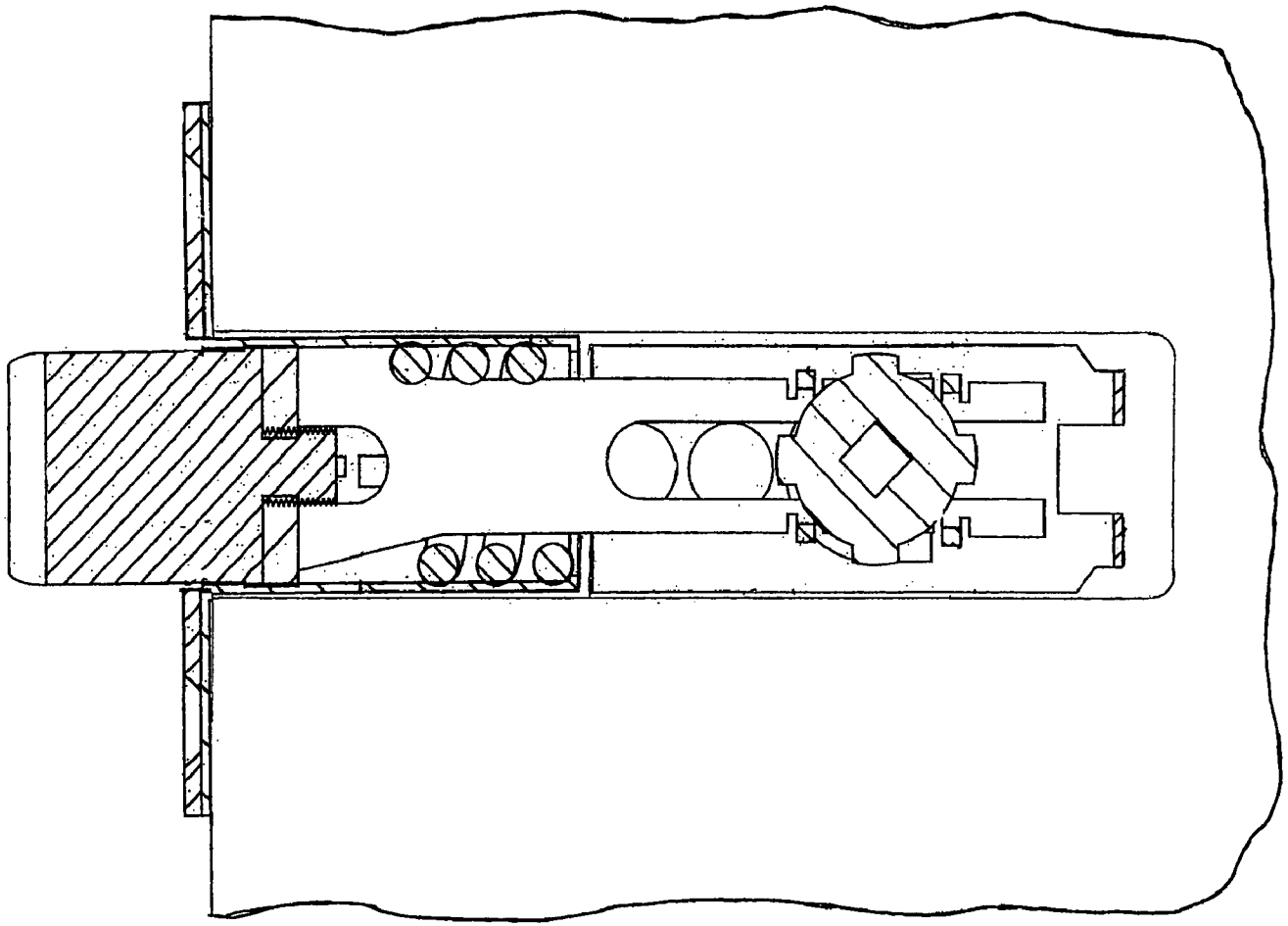
FIG. 14 is a cross-sectional view of the adjustable latch of the present invention, as installed in a door, with the tongue exposed.

Strike plate cover 20 of latch 10, as seen in FIGS. 1, 2, 6, and 8 may be of any suitable shape known in the art, in the present embodiment a generally rectangular shaped strike plate cover was preferred. The dimensions of strike plate cover 20 may be varied according to the door opening. Strike plate cover 20 may be constructed of any known material in the art, but not limited to brass, other metals or alloys thereof. Strike plate cover 20 has front surface 22 and rear surface 21. Surfaces 21 and 22 are surrounded by left and right side surfaces 23 and 25, respectively, and top and bottom surfaces 26 and 24 respectively, so as to form a continuous outer wall. Strike plate cover 20 may have three apertures, 27, 28, and 29, which extend from front to rear surface, 22 and 21 respectively. Apertures 27 and 28 may be any suitable shape known in the art, but not limited to a circle, square, or rectangle. Generally, apertures 27 and 28 will have a shape and size, suitable for receiving a screw or other fastening mechanism, for mounting purposes, i.e. circular shape for receiving a screw, as in the present embodiment. In addition, apertures 27 and 28 have inner circumferential walls 30 and 31, respectively. Walls 30 and 31 may have recesses that run from front surface 22 to the center of walls 30 and 31, so that the mounting screws, when fully screwed into the doorjamb, will be flush with front surface 22 so as to create a finished aesthetically pleasing look to the user. Aperture 29 may be of any suitable shape and size, in the present embodiment aperture 29 was of similar shape and size of head portion 40, so as to be able to receive head portion 40 of latch 10. Aperture 29 has a circumferential inner wall 32 that has a generally "C" shape. Circumferential inner wall 32 has a vertical portion 33 that connects that connects top edge 34 of inner circumferential wall 32 to bottom edge 35 of inner circumferential wall 32. In normal operation of the latch, the user will mount a strike plate cover 20 over the adjustable door latch assembly 10, once the latch assembly 10 has been fit into a bored cavity in the door (FIG. 14), and the user will also mount a strike cover plate 20 in the door jamb, located opposite the side of hinged portion of the door. When the user closes the door, the strike plate of the door frame (not shown), will cause head portion 40 to retract, thus allowing the door to close. Once head portion 40 of latch 10 becomes aligned with aperture 29 of strike plate cover 20 mounted on the door jam, spring 60 of latch 10 will force head portion 40 through aperture 29, into a bored cavity of the door frame, thus keeping the door in a closed or stopped position.

Figure 1B:
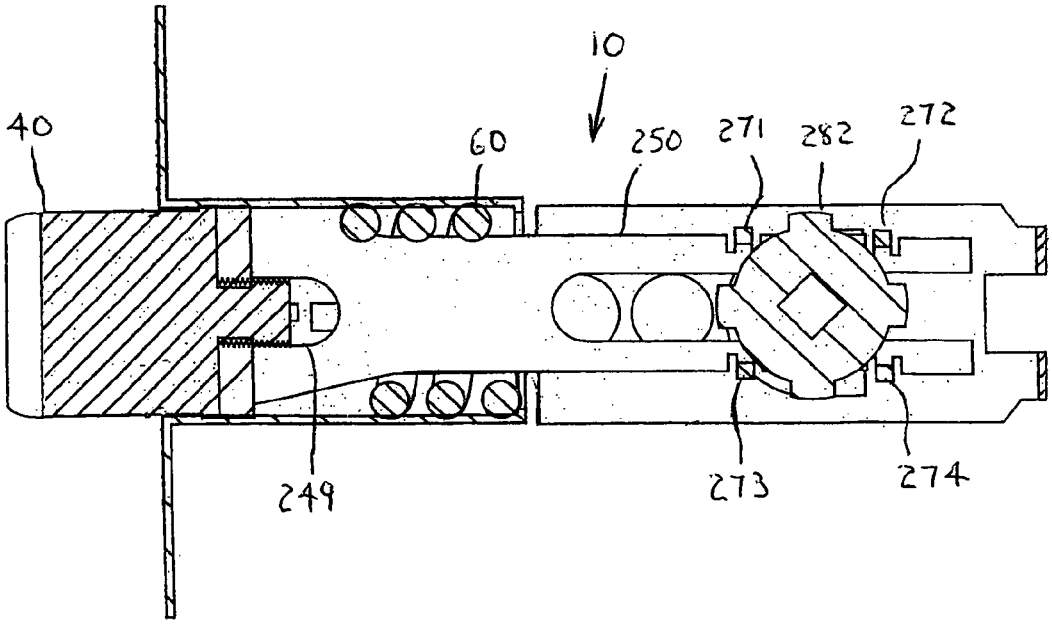
Figure 2:
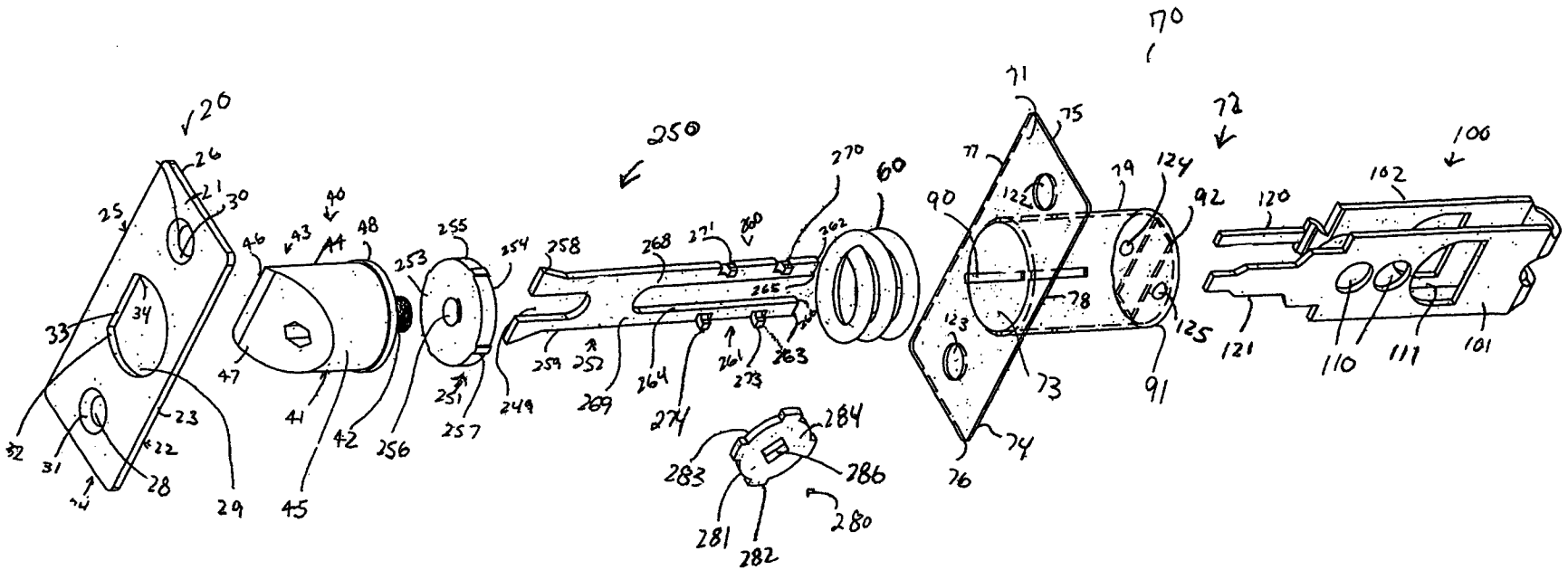
FIG. 2 is an exploded view, of FIG. 1, of the door latch of the present invention.
Figure 3A:
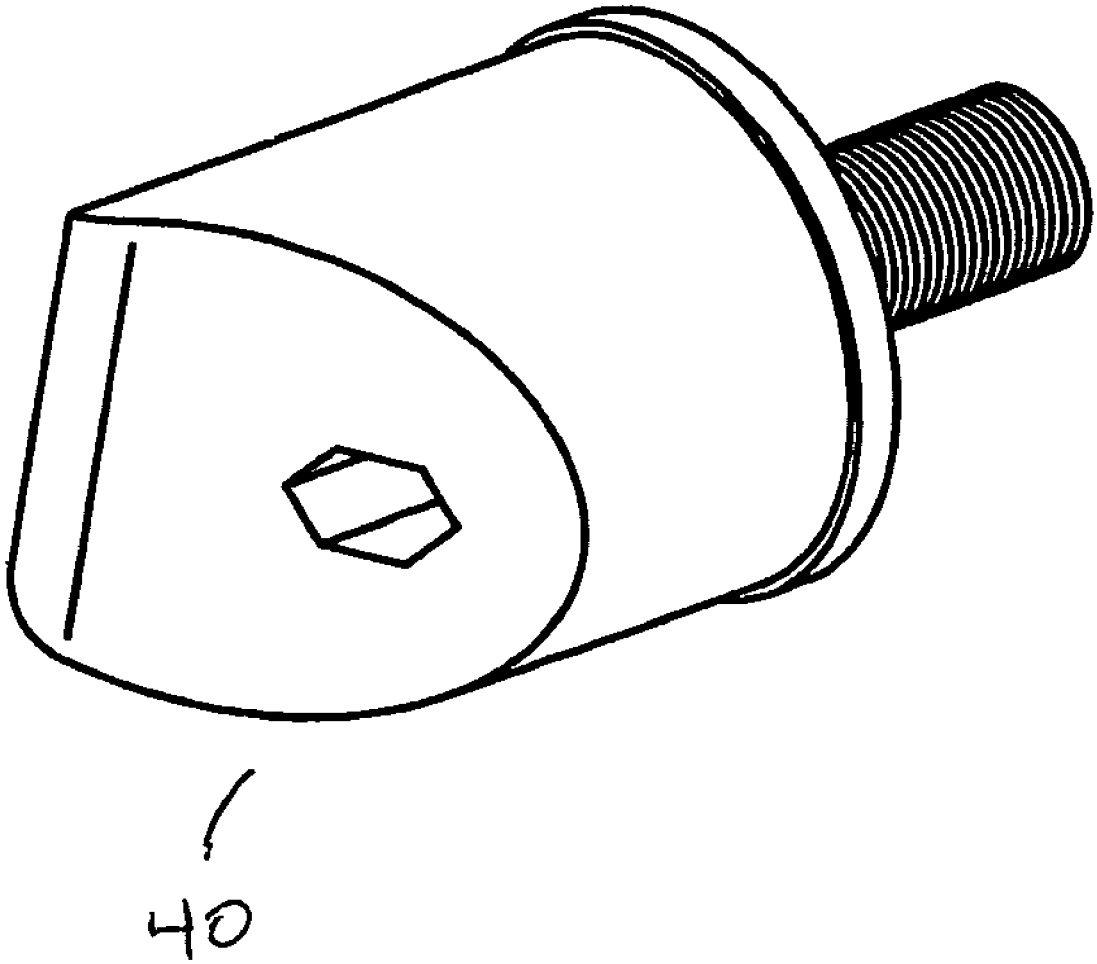
FIG. 3A is an example of the tongue male portion of the door latch of the present invention, with a hex aperture.
Figure 3B:
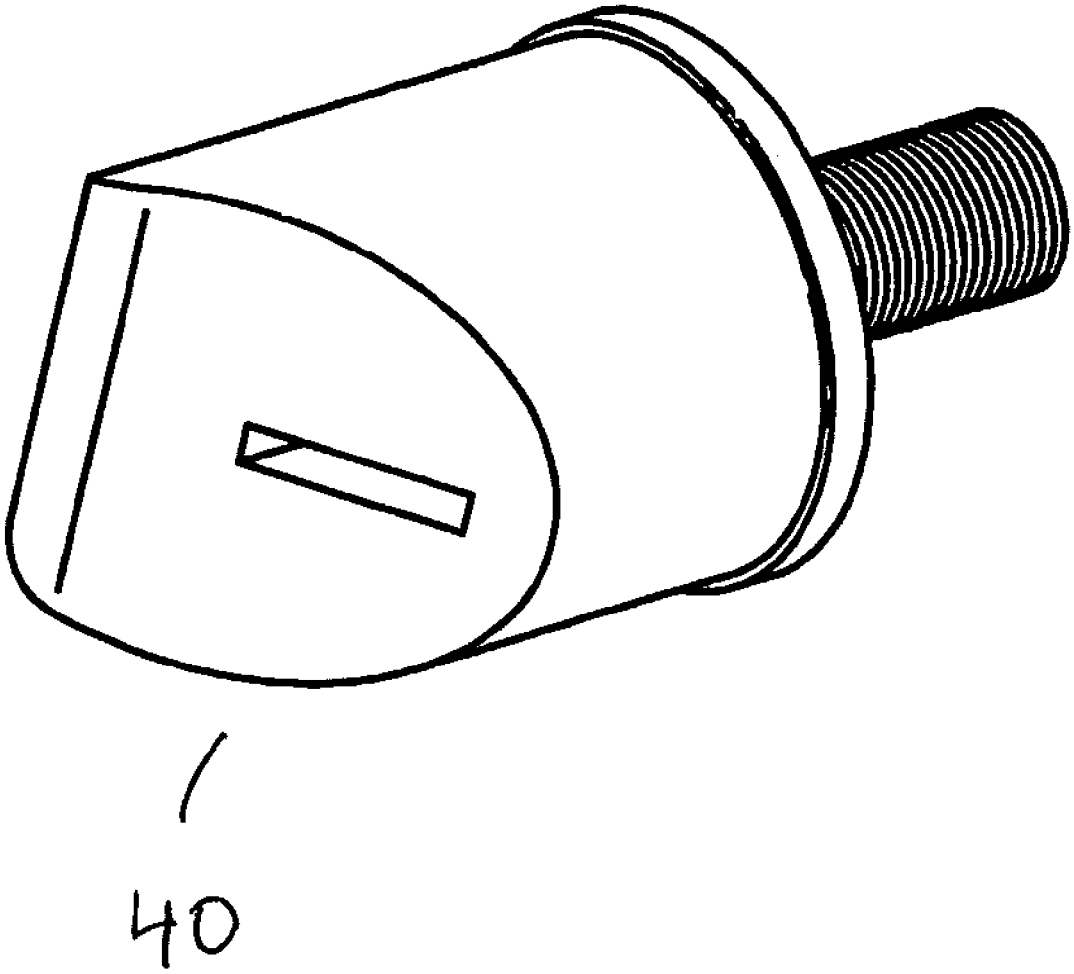
FIG. 3B is an example of the tongue male portion of the door latch of the present invention, with a rectangular slit.
Figure 3C:
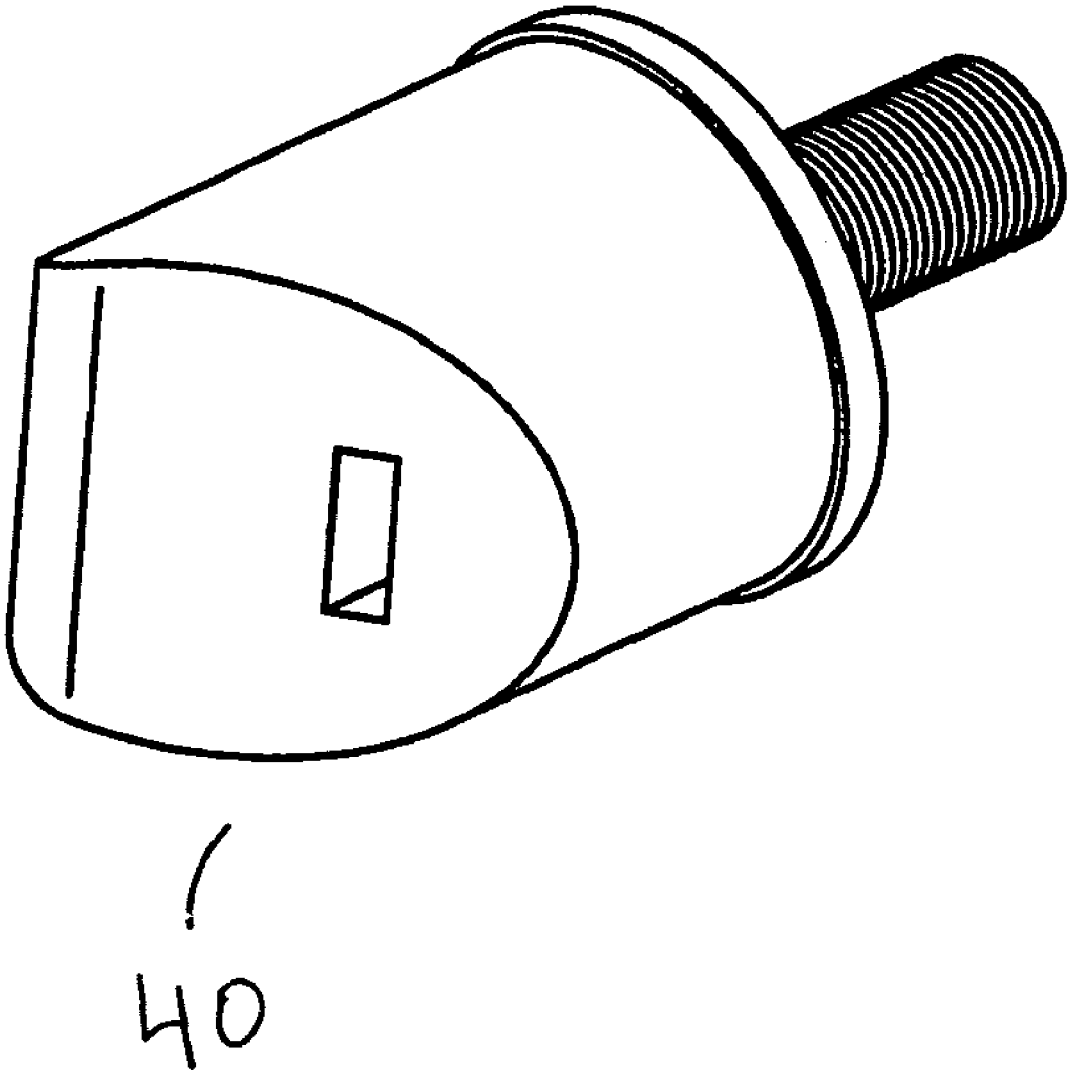
FIG. 3C is an example of the tongue male portion of the door latch of the present invention, with a rectangular aperture.
Figure 5:
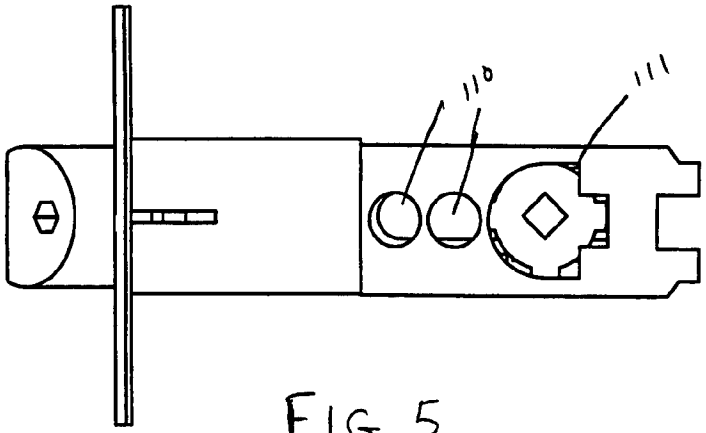
FIG. 5 is a side view, of FIG. 1, of the door latch of the present invention.
Figure 7:
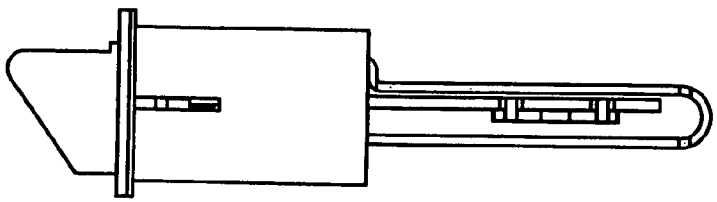
FIG. 7 is a perspective view of the adjustable latch of the present invention, orientated in the y axis of the Cartesian coordinate system.
Figure 4:
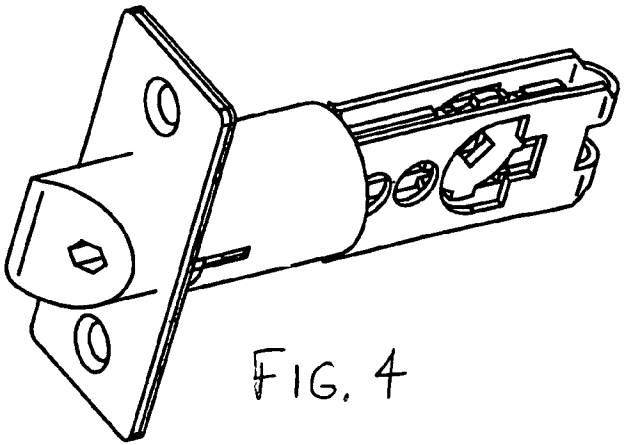
FIG. 4 is a front end view, of FIG. 1, of the complete assembly of the present invention.
Figure 6:
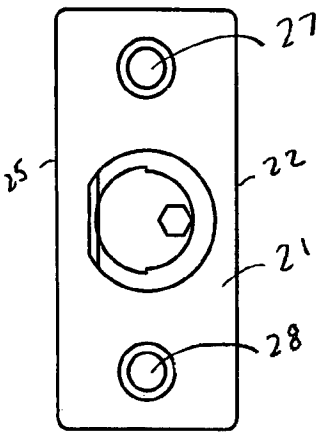
FIG. 6 is an end view of the strike plate cover of FIG. 1.
Figure 9:
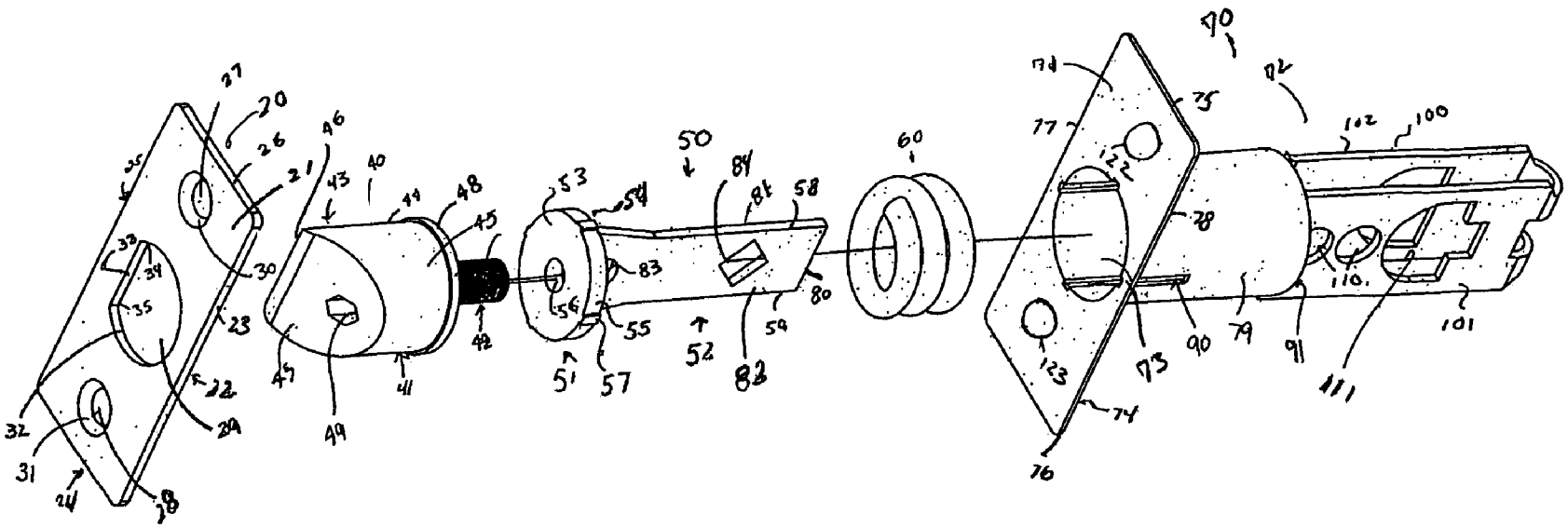
FIG. 9 is an exploded view, of FIG. 8, of the adjustable latch of the present invention.
Figure 12:
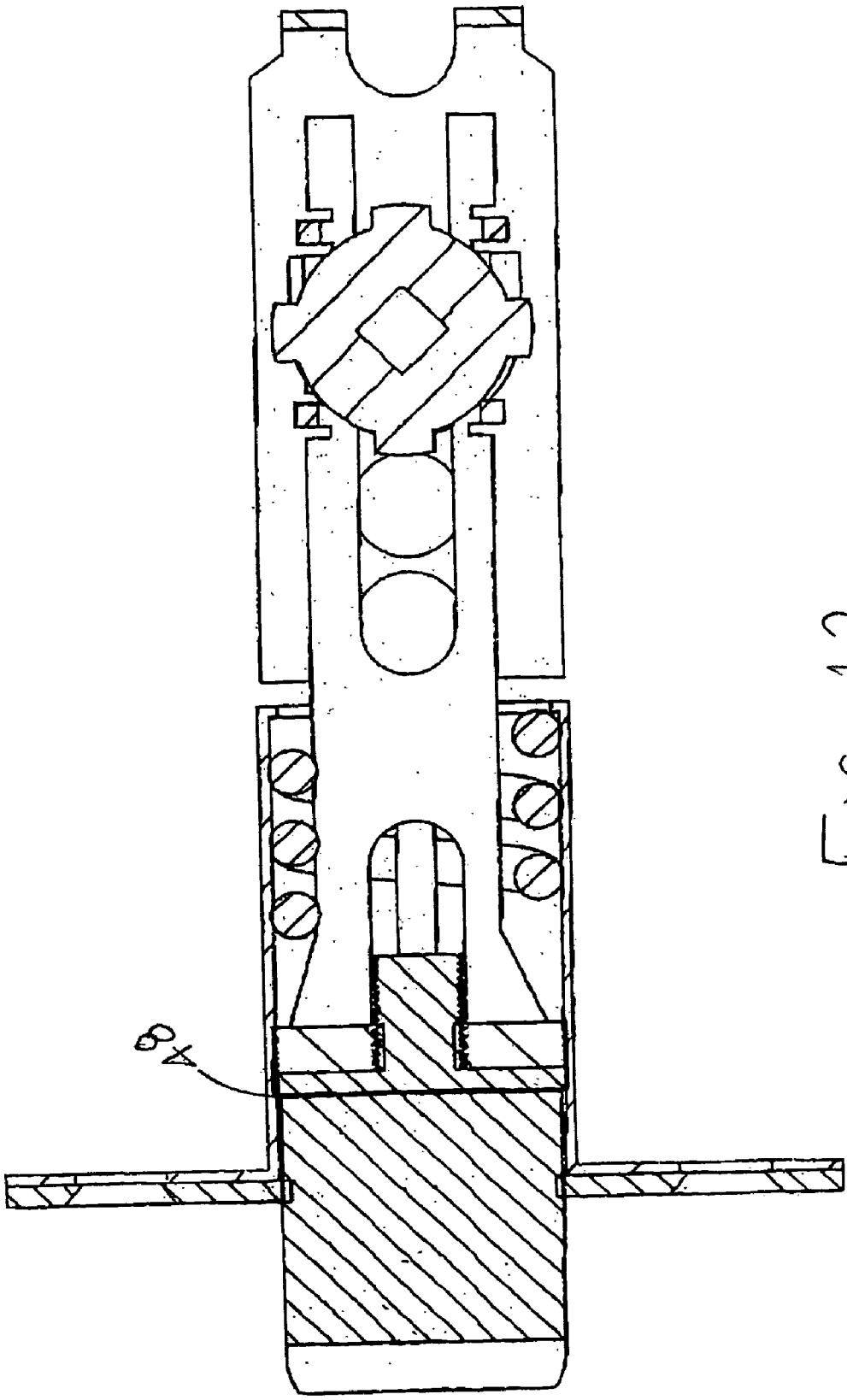
FIG. 12 is cross-sectional side view of the latch of the FIG. 11.
Figure 13:
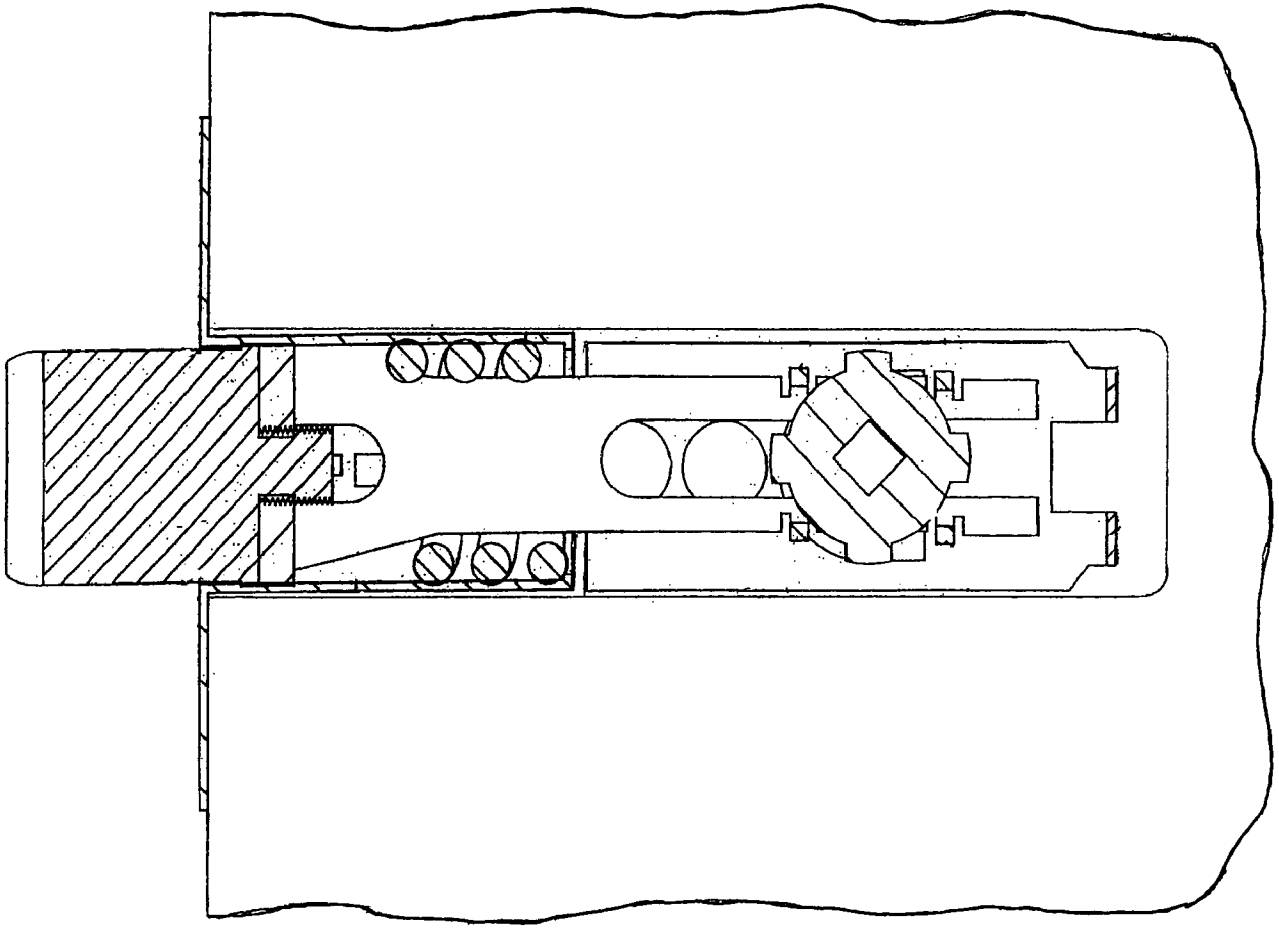
FIG. 13 is a cross-sectional view of the adjustable latch of the present invention, with the latch inserted into a bored cavity in a door, and with the strike cover plate removed.

Latch 10 also has head portion 40, as seen in FIGS. 1, 2, 3, and 9. Head portion 40 may be manufactured from of any suitable known material in the art including but not limited to brass, other metals or alloys thereof. Head 40 has three portions, a tongue portion 41, a base portion 48, and a threaded protrusion portion 42 extending from the base of head 40. The head can be made from a single piece or two or more pieces together. The base portion 48 is generally a plate with a flanged member 48A, which is of a slightly larger diameter than the tongue portion 41. The plate's flange 48A can form a recess for receiving tongue portion 41. Threaded protrusion portion 42 may be integrally formed with head portion 40 or threaded protrusion portion 42 may be a separately attached member. In the latter embodiment threaded portion 42 may be attached to the base of head 40 by any suitable attaching means known in the art including but not limited to gluing, screwing, etc. In a preferred embodiment threaded portion 42 was integral part of head 40. Tongue portion 41 of head 40 as mentioned previously has generally the same shape and size as aperture 29 of strike plate cover 20. Tongue portion 41 has an inner, generally rectangular side 43 that is aligned with vertical portion 33 of aperture 29 of strike plate cover 20, as seen in FIG. 9. Extending from top edge 44 of inner rectangular side 43 is a cylindrical "C" shaped portion 45 that is aligned with inner circumferential wall 32 of strike plate cover 20. Tongue 41 has a slanted, generally parabolic shaped surface 47 that extends from side edge 46 of inner rectangular side 43 to approximately the midpoint of head 40, as seen in FIG. 2. It will be appreciated that a variety of different shaped heads are known in the art, not just ones with a parabolic surface. In addition, located near the center of parabolic surface 47, or other suitable location on the surface of the tongue, may be an aperture 49. Aperture 49 may be any suitable shape known in the art, but not limited to a square, rectangle, a line, or any polygonal shape, as seen in FIGS. 3 A, B, or C. Aperture 49 may also be V shaped, U shaped, or combinations of straight or curved portions. Aperture 49 may extend from parabolic surface 47 to base of head 40, or aperture 40 may extend only partially inside head 40. In one type of embodiment, located near the base of head 40 may be a flanged member 48, as seen in FIGS. 2 and 12, generally circumferential in shape. In another type of embodiment head 40 need not implement a flange member 48 that goes around the entire circumference of the head, one or more extensions extending outwardly from the base may also be used. As mentioned above flange 48 may be implemented, however the functionality of latch 10 would not affected if flange 48 were not present. If a flange 48 is desired flange 48 may be integrally formed with head 40, or flange 48 may be a separately attached member. In addition flange 48 has an outer circumferential surface that has a larger diameter then base of head 40, and a the same as or less then the diameter of aperture 73 of plate portion 71 of housing 70, as seen in FIGS. 2 and 12. Flange 48, if implemented would act so as to limit exposure of tongue portion 41 of head portion 40. Head 40 has threaded protrusion 42 extending from base of head 40, as seen in FIG. 2. Protrusion 42 is generally cylindrical in shape with threaded grooves located on the outer surface thereof. Protrusion 42 may be constructed of any suitable known material in the art but not limited to brass, other metals or alloys thereof. In the present invention threaded protrusion 42 was constructed from metal alloy. Depending on the user's needs, protrusion 42 may be manufactured to come in a variety of different lengths. In normal operation if the user wishes to adjust head 40 of latch 10 the user would place the appropriate shaped instrument, such as a flat head screwdriver, Philips head screwdriver, hex head screwdriver, or any other suitable known instrument in the art, into aperture 49, preferably the shape of a tip of the instrument. After insertion of the appropriate instrument into aperture 49, the user may rotate head 40 360 degrees, in either a clockwise or counterclockwise direction. In normal operation head 40 may only be rotated in complete revolutions, i.e. integral multiples of 360 degrees, and may be done so either with head 40 in the retracted position (FIG. 1A), or with strike plate cover 20 removed (FIG. 13).

Figure 11:
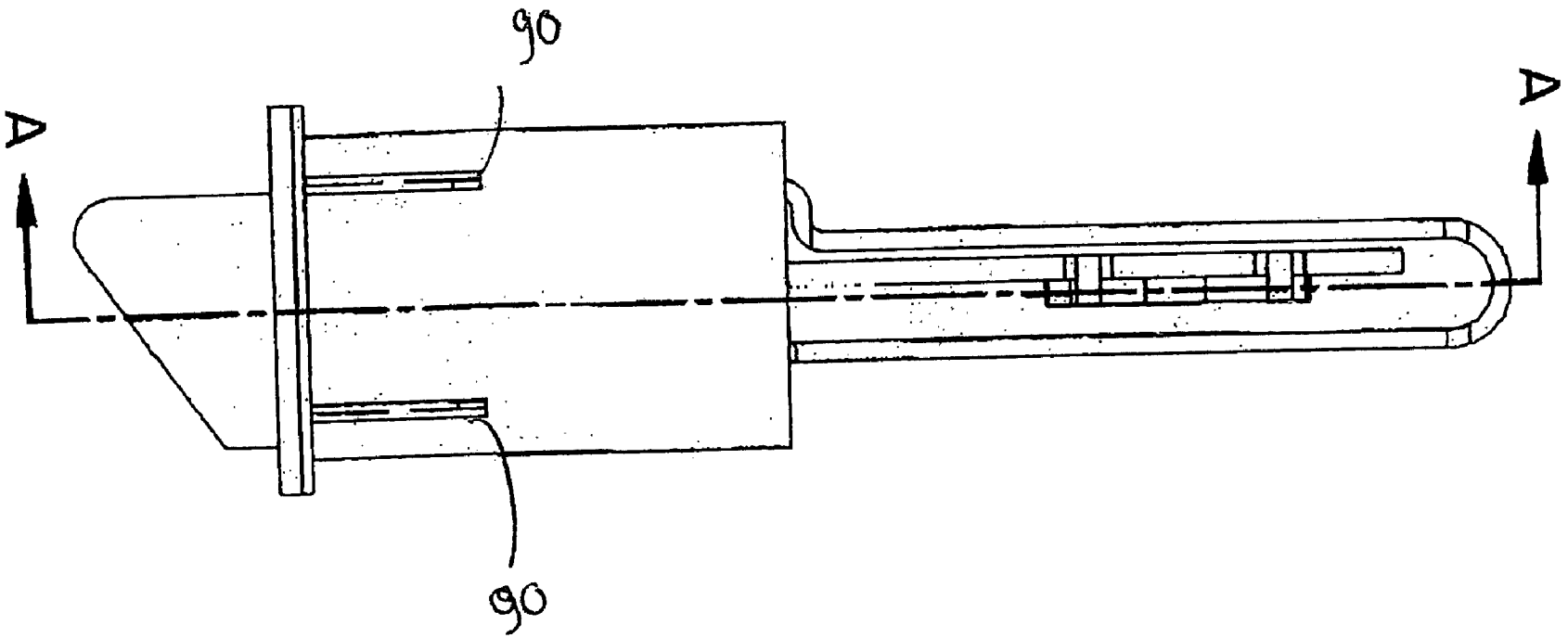
FIG. 11 is a top or bottom view of an embodiment latch of the present.

In one embodiment latch 10 may have adjustment stem 50, as seen in FIG. 9. Adjustment stem 50 has two portions a base portion 51, and a plate portion 52. Base portion 51 may be of any suitable known shape in the art including but not limited to a circle, square, etc. In this embodiment base portion 51 was circular in shape. Base 51 has top surface 53 and bottom surface 54, along with circumferential outer surface 55, as seen in FIG. 2. Bottom surface 54 of threaded disc 51 may have a groove located thereto to receive plate portion 52. In addition, located near the center of base 51 is a threaded aperture 56. Aperture 56 is designed so as to be able to receive threaded protrusion 42 of head 40. Aperture 56 has threaded inner circumferential wall, which may extend from top surface 53 to bottom surface 54, or aperture 56 may extend only partially therein. Located on circumferential outer surface 55 is at least one rib portion 57. Rib portion 57 prevents receiving portion 51 from rotating when the user rotates head 40. Rib portion 57 also prevents side to side movement of the head. In normal operation rib portion 57 of circumferential surface 55 fits inside parallel groove 90 of housing 70, as seen in FIG. 11.

In another embodiment, as seen in FIG. 2, the preferred embodiment, latch 10 has adjustment stem 250, as seen in FIG. 2. Adjustment stem 250 has two portions a base portion 251, and a plate portion 252. Base portion 251 may be of any suitable known shape in the art including but not limited to a circle, square, etc. In the present invention base portion 251 was circular in shape. Base 251 has top surface 253 and bottom surface 254, along with circumferential outer surface 255, as seen in FIG. 2. Bottom surface 254 of threaded disc 251 may have a groove located thereto to receive plate portion 252. In addition, located near the center of base 251 is a threaded aperture 256. Aperture 256 is designed so as to be able to receive threaded protrusion 42 of head 40. Aperture 256 has threaded inner circumferential wall, which may extend from top surface 253 to bottom surface 254, or aperture 256 may extend only partially therein. Located on circumferential outer surface 255 is at least one rib portion 257. Rib portion 257 prevents receiving portion 251 from rotating when the user rotates head 40. Rib portion 57 also prevents side to side movement of the head. In normal operation rib portion 257 of circumferential surface 255 fits inside parallel groove 90 of housing 70.

Adjustment stem 50 as mentioned earlier has plate portion 52, as seen in FIG. 9. Plate portion 52 may be of any suitable known shape in the art including but not limited to square, rectangle, etc. In one embodiment plate portion 52 was a generally trapezoidal shape, having, a top surface 58, a bottom surface 59, a right side surface 81, a left side surface 82, and front end surface 80. Plate portion 52 may be an integral part of adjustment stem 50, or plate portion 52 may be a separate member affixed via any suitable known means, adhesive or friction fit. In this embodiment plate portion 52 was a separate member affixed to surface 54 of threaded disc portion 51 via a tongue and groove press fit. Located near the rear end of plate portion 52 may be an opening 83, which may be implemented to receive a segment of thread portion 42, as in the present embodiment. Opening 83 may be of any suitable shape known in the art including but not limited to a rectangle, square, and the like. In this embodiment an oval shaped opening was implemented. Plate portion 52 may have at least one aperture that extends from right side surface 81 to left side surface 82. The shape of the aperture may be of any suitable known shape in the art including but not limited to a circle, square, rectangle. In the present embodiment one aperture 84, with a generally rectangular shape was implemented. The dimensions of aperture 84 will be of such proportion to facilitate receiving a corresponding door spindle.

In another embodiment plate, as seen in FIG. 2, the preferred embodiment, portion 250 may have a double u shape with two u shaped cutouts back to back. Plate portion 250 may have two prongs extending from bottom surface 254 of plate portion 52, upper prong 260 and lower prong 261, as seen in FIG. 2. Upper and lower prongs, 260 and 261 respectively, have front surfaces 262 and 263, respectively, as seen in FIG. 2. Extending from lower front edge 265 of front surface 262, to the upper front edge 266 of front surface 263, is inner circumferential surface 264. Plate portion 250 also has top surface 258 and bottom surface 259, as seen in FIG. 2. In addition, plate portion 250 will have limiting members located on left side surface 268 of upper prong 260 and left side surface 269 of lower prong 261. Limiting members may extend outwardly generally perpendicularly from side surfaces 268 and 269. In one embodiment there may be two limiting members, 270 and 271, on left side surface 268 of prong 260, or in another embodiment there may be two limiting members, 273 and 274, on left side surface 269 of prong 261. In yet another embodiment one may preferably implement four limiting members, as in the present invention, as seen in FIG. 2. One may implement any suitable type of limiting member known in the art including but not limited to pegs, pins, or the like. Plate portion 252 may be an integral part of adjustment stem 250, or plate portion 252 may be a separate member affixed via any suitable known means, adhesive or friction fit. In the present invention plate portion 252 was a separate member affixed to surface 254 of threaded disc portion 251 via a tongue and groove press fit. In addition to limiting members 270, 271, 273, and 274 of plate portion 252, located near the rear end of plate portion 52 may be an opening 249, which may be implemented to receive a segment of thread portion 42, as in the present embodiment, as seen in FIGS. 1A/B and 2. Opening 249 may be of any suitable shape known in the art including but not limited to a rectangle, square, and the like. In the present invention an oval shaped opening was implemented. In addition opening 249 may be smooth or threaded, in the preferred embodiment opening 249 is smooth. In normal operation when head 40 is retracted limiting members, 270, 271, 273, and 274, or some combination thereof, will contact the surface of at least one pair of limiting members 282 of handle disk 280, as seen in FIG. 1B. When head 40 is not in a retracted position, i.e. exposed, there will be no contact between limiting members, 270, 271, 273, and 274, of plate portion 252, and limiting members 282 of handle disk 280, as seen in FIG. 1A.

Handle disk 280 is a generally circular disc with outer circumferential surface 281. Located on and extending perpendicularly from outer circumferential surface 281 is at least one generally rectangular limiting members (hereinafter members) 282, as seen in FIG. 2, however, one may use any suitable shape known in the art for members 282. Members 282 may be an integral part of handle disk 280, or members 282 may be a separately attached element, attached by any suitable known means in the art. In the preferred embodiment four integrally formed members were implemented. In addition to having members 282 located on outer circumferential surface 281, handle disk 280 may have an aperture located near the center, and extending from, left surface 284 to right surface 285. Aperture 286 may be any suitable shape known in the art including but not limited to a square, circle, rectangle, or any other polygon. In the present embodiment a square was the preferred shape for aperture 286. The dimensions of apertures 286 will be of such proportion to facilitate receiving a corresponding door spindle.

Operation of the adjustable door latch in this embodiment is the same as in the previously mentioned embodiments.

Figure 8:
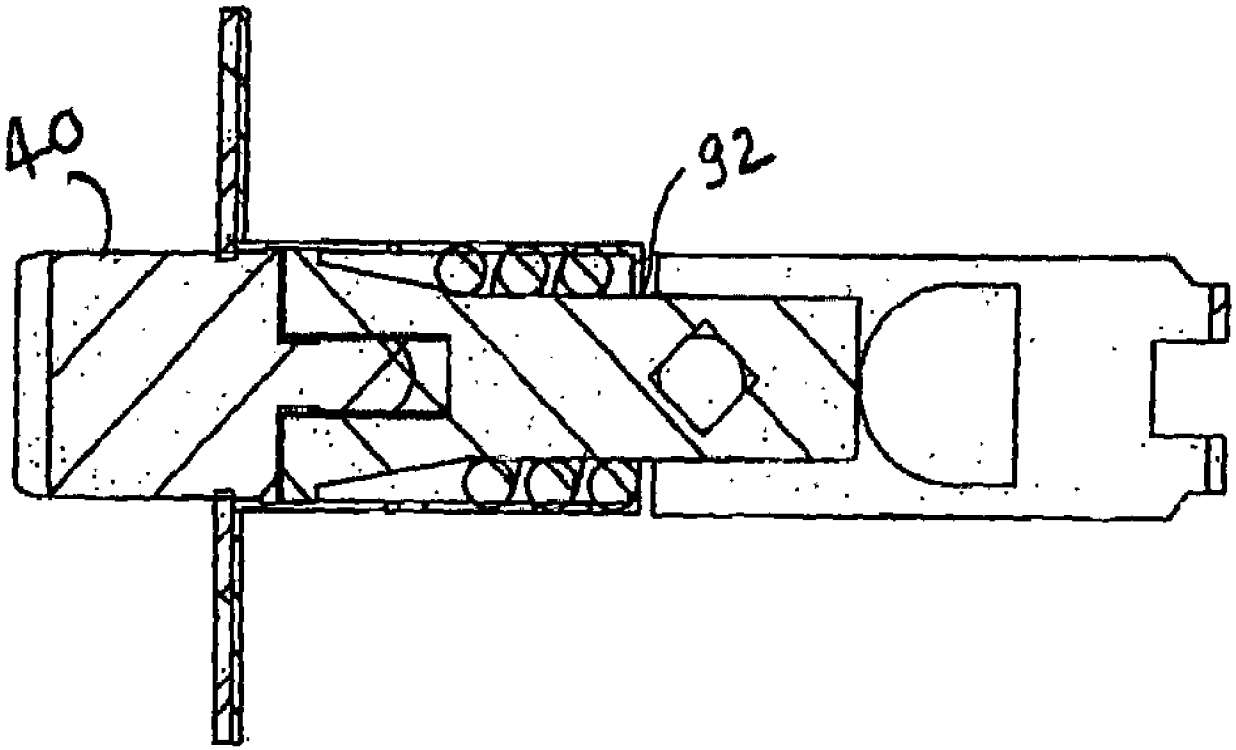
FIG. 8 is cross-sectional view of another embodiment of the adjustable latch of the present invention with the tongue exposed.

Latch 10 has a resilient member that rests on plate portion 52 of adjustment stem 50 in one embodiment, or rests on plate portion 252 of adjustment stem 250 in another embodiment, as seen in FIGS. 8 and 1 respectively. One may use any suitable type of resilient member known in the art including but not limited to coil springs, helix springs, torsion springs, plate springs, etc. In the present embodiment a coil spring 60 was the preferred resilient member implemented. In normal operation spring 60 applies enough force to keep head 40 in an exposed position. In addition, spring 60 may extend a distance equal to the length of either plate portion 52, in one embodiment, or plate portion 252, in another embodiment, or spring 60 may extend a distance less the length of either plate portion 52 or 252.

Head 40, adjustment stem 50 in one embodiment, or adjustment stem 252 in another embodiment, and spring 60 may all be housed inside of housing member 70. Housing member 70 has a front plate portion 71, and a rear end portion 72. Front plate portion 71 may be any suitable shape known in the art including but not limited to a square, rectangle, or circle. In the present embodiment plate portion 71 was of a generally rectangular shape. In addition plate portion 71 is generally the same material and the same size as striking plate 20; this is for illustration purposes only and is in not in any way a limiting factor. Plate portion 70 has front and rear surfaces 73 and 74 respectively, along with top, bottom, right, and left sides, 75, 76, 77, and 78 respectively. An aperture 73 is located preferably near the center of plate portion 71, but could be toward one of the sides. Aperture 73 may be of any suitable shape known in the art including but not limited to a circle, square, or rectangle. In the present invention the preferred shape for aperture 73 was a circle. In addition, aperture 73 has a diameter at least large enough to receive spring 60, adjustment stems 50 or 252, and head portion 40. Plate portion 71 may also have two apertures 122 and 123, used for mounting, similar in shape, size, and functionality as apertures 27 and 28 of plate portion 20.

Figure 10:
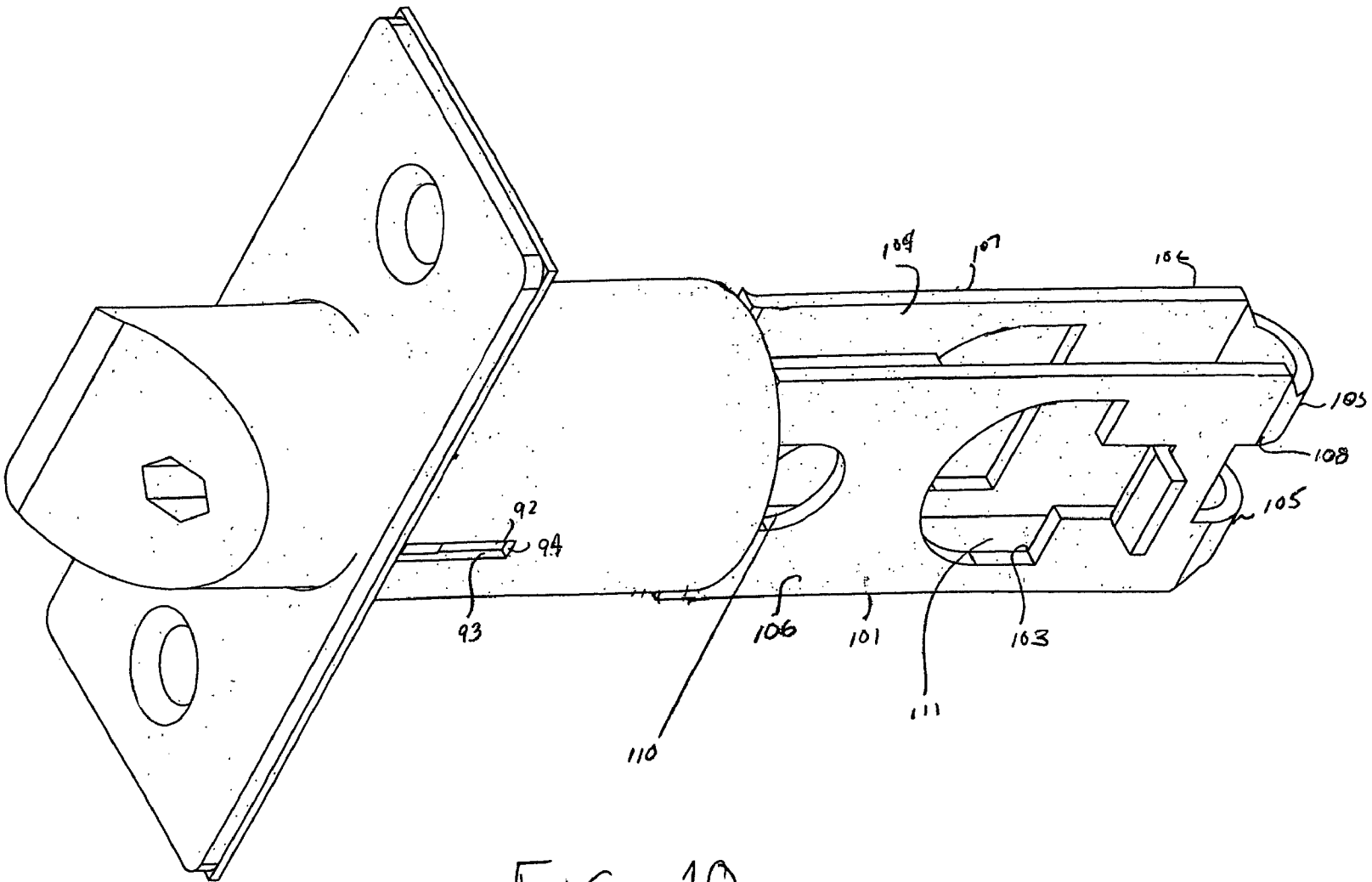
FIG. 10 is a front end view, of FIG. 8, of the male tongue portion inserted into the strike plate cover of a different embodiment of the present invention.

As mentioned previously housing 70 has a rear end potion 72, which includes a drum 79 and a stem 100. Extending from rear surface 74 is a generally cylindrically shaped drum 79. Drum 79 has a diameter and length that will allow drum 79 to house spring 60, adjustment stems 50 or 252, and adjustable disk plate 51 of head 40. Located on rear surface of drum 79 may be a slot 92, as seen in FIG. 2, which may be used to receive and retain either plate portion 52, or plate portion 252. If one were to implement slot 92, then two additional apertures 124 and 125, or addition slots may also be implemented, these slots or apertures would be located adjacent and on each side of slot 92, so as to be able to receive a portion of stem 100. In another embodiment one may leave drum 79 open ended. In the present invention a slot was implemented to receive and retain either plate portion 52, or plate portion 252. In addition, drum 79 may have at least one groove 90 that may extend from front surface 73 to the distal end 91 of drum 79. In another embodiment groove 90 may extend to a point less than the full length of drum 79, as in the present invention, seen in FIGS. 2 and 9. Groove 90 is configured so as to be able to retain rib 57 of base portion 51 of adjustment stem 50 of latch 10, as seen in FIG. 9, or groove 90 is configured so as to be able to retain rib 257 of base portion 251 of adjustment stem 250 of latch 10, as seen in FIG. 2. Groove 90 may be of any suitable shape known in the art including but not limited to oblong, rectangular, etc. In the present invention a rectangular groove was preferred, as seen in FIG. 10. Groove 90 may have top and bottom surfaces, 92 and 93 respectively, and rear surface 94, as seen in FIG. 10. As mentioned above there may be one or a plurality of grooves located on drum 79, as seen in FIG. 11.

Latch 10 has stem portion 100, as seen in FIGS. 2 and 9 that may be an integral member of housing 70. In another embodiment stem portion 100 may be a separate member attached to drum 79, via members 120 and 121 of stem portion 100. With that embodiment one may implement slot 92, with the two additional slots or apertures, as mentioned above. In yet another embodiment stem portion 100 may be unattached to drum 79. Stem member 100 may be manufactured from any suitable known material in the art including but not limited to brass, other metals or alloys thereof. Stem member 100 is generally rectangular in shape; however any suitable shape known in the art may have been implemented. Stem member 100 has left and right sidewalls, 101 and 102 respectively, as seen, in FIGS. 2, 9, 10. In addition, sidewalls 101 and 102 have inside surfaces 103 and 104 respectively, as seen in FIG. 10. Sidewalls 101 and 102 also have outside surfaces 106 and 107 respectively. Sidewalls 101 and 102 are connected by member 105 that extends from one sidewall to the other, as seen in FIGS. 10. Member 105 is generally convex but other shapes are possible. Convex member 105 may extend from rear edge 108 of outside surface 106 to rear edge 109 of outside surface 107. Convex member 105 may be one member, or convex member 105 may be two separate members, as in the present invention. Convex member 105 may be a variety of shapes as necessary. Stem member 100 has at least one pair of apertures 110, one aperture is located on sidewall 101 that extends from outside surface 106 of sidewall 101 to inside surface 103 of sidewall 101, as seen in FIGS. 10. Another aperture is located on sidewall 102 that extends from outside surface 107 of sidewall 102 to inside surface 104 of sidewall 102, as seen in FIGS. 10. Apertures 110 may be any suitable shape known in the art including but not limited to a circle, square, rectangle, or polygon. In the present invention three pairs of apertures were implemented two were generally circular in shape apertures 111, and one was polygonal, apertures 110 which resembled a mushroom or rivet, as seen in FIGS. Each pair of apertures is aligned along the same central axis of rotation. In normal operation, depending on the designed installation, the spindle of a door handle will pass first through one of the apertures, located on either sidewall 101 or sidewall 102, then through a corresponding aperture on plate portion 52 of adjustment stem 50, or through aperture 286 of handle disk 280, then through the corresponding aperture of the opposite sidewall.

After installation if there needs to be an adjustment to the door latch. The user may insert an appropriate tool, for example a hex head tool, into aperture 49. If the user desires more of head portion 40 to be exposed then the user will rotate head portion 40 in a counterclockwise motion 360°, or any integral multiple of 360°. If the user desires less of head portion 40 to be exposed then the user will rotate head portion 40 in a clockwise motion 360°, or any integral multiple of 360°. The direction of turning can be switched if desired.

As various changes could be made in the above constructions without departing from the scope of the invention, it is intended that all matter contained in the above description shall be interpreted as illustrative and not in a limiting sense. In the view above it will be seen that several objects of the invention are achieved and other advantageous results attained.

What is claimed is:

1. A door locking assembly comprising:

a strike plate having an aperture;

a housing assembly, attached to said strike plate, having a housing portion and a rear end portion;

an adjustment stem positioned inside said housing assembly, said adjustment stem having a base portion, a plate portion, and an adjustable head portion threadably connected to said base portion;

an actuator for moving said adjustment stem between a locking position, wherein said adjustment stem is in a position distal to said rear end portion, and an unlock position, wherein said adjustment stem is in a position proximal to said rear end portion;

a spring member biasing said adjustment stem toward said locking position;

said base portion comprises a generally circular disk having a receiving opening and at least one fixed rib located on a circumferential surface of said disk that fits inside grooves located in an inner surface of said housing;

said adjustable head portion having a head that extends from said housing portion to lock said door locking assembly when said adjustment stem is in said locking position and to unlock said door locking assembly when said adjustment stem is in said unlock position, an aperture on a front surface, and a threaded protrusion that is threadably received into said receiving opening of said circular disc;

wherein, in order to adjust the position of the head with respect to said housing assembly, 1) the striker plate is detached from the housing assembly, allowing said head to rotate by means of a rotational means being inserted into said aperture in order to vary the distance that said threaded protrusion portion extends from said housing, or 2) with the striker plate attached to said housing assembly, said aperture receives rotational means, said head is pushed away from said strike plate aperture, moving said adjustment stem toward said second position against said spring biasing force, so that said head is allowed to be rotated by said rotational means in order to vary the distance that said threaded protrusion portion extends from said housing.

2. A door locking assembly according to claim 1, wherein said actuator comprises a handle disk mounted adjacent to the stem, said handle disk being rotatable to move said adjustable stem from a first position to a second position.

3. A door locking assembly according to claim 2, wherein said adjustable stem has one or more limiting members extending therefrom that interacts with said handle disk as said handle disk is turned.

4. A door locking assembly according to claim 1, wherein said groove may extend from a front surface to a distal end of a drum in said housing.

5. The door locking assembly according to claim 1, wherein said groove in said inner surface of said housing extends from a front surface of said drum.

6. The door locking assembly according to claim 1, wherein said base portion has a front surface and a rear surface and said front and rear surfaces are generally transverse to the direction of the plate portion.

7. The door locking assembly according to claim 1, wherein one of said head or said base portion of said adjustment stem has a male threaded member that is received by a female threaded member in the other of said head or said base portion of said adjustment stem.

8. The door locking assembly according to claim 1, where said plate portion has a double u shape with two u shaped cutouts back to back.

9. The door locking assembly according to claim 8 wherein said plate portion has an upper and lower prong extending from bottom surface of the plate portion.

10. The door locking assembly according to claim 9 wherein said upper prong having at least one limiting member extending outwardly, generally perpendicular on the left side surface.

11. The door locking assembly according to claim 10 wherein the limiting member is one of a pin or a peg.

12. The door locking assembly according to claim 9 wherein said plate portion has two limiting members extending outwardly, from said plate portion on an upper prong.

13. The door locking assembly according to claim 9 wherein said plate portion has two limiting members extending outwardly, from said plate portion on a lower prong.

* * * * *